United States Patent [19]

Cormier et al.

[11] 4,241,694

[45] Dec. 30, 1980

[54] METERING ROLL WITH FIXED SLIDER STRIPS

[75] Inventors: Raymond G. Cormier, Nashua; Leo O. Lutz, Hollis, both of N.H.

[73] Assignee: Nashua Corporation, Nashua, N.H.

[21] Appl. No.: 56,127

[22] Filed: Jul. 9, 1979

[51] Int. Cl.[3] ..... B05C 1/08

[52] U.S. Cl. ..... 118/647; 101/363; 101/350; 118/262; 118/661; 355/10; 430/117

[58] Field of Search ..... 355/10; 427/15, 16, 427/17; 118/261, 262, 661, 647; 101/350, 363, 207, 208; 430/117

[56] References Cited

U.S. PATENT DOCUMENTS

| | | | |
|---|---|---|---|
| 2,644,424 | 7/1953 | Bixby | 118/262 X |
| 3,245,377 | 4/1966 | Gettel | 355/10 |
| 3,830,199 | 8/1974 | Saito et al. | 118/661 |
| 3,907,423 | 9/1975 | Hayashi et al. | 355/10 |
| 3,957,016 | 5/1976 | Yamada | 427/15 X |
| 4,023,899 | 5/1977 | Hayashi et al. | 427/15 X |
| 4,052,959 | 10/1977 | Hayashi et al. | 118/262 X |
| 4,135,475 | 1/1979 | Bomers | 118/262 X |

FOREIGN PATENT DOCUMENTS

| | | | |
|---|---|---|---|
| 269855 | 11/1964 | Australia | 355/10 |

*Primary Examiner*—Shrive P. Beck

*Attorney, Agent, or Firm*—Kenway & Jenney

[57] ABSTRACT

A metering roll, employed between the developing station and the transfer station of a photocopier which uses a liquid toner, controls the thickness of the liquid on the photosensitive drum surface when it is presented to the transfer station. Elements fixed between the drum and roll maintain the central metering portion in a substantially constant spaced apart relationship to the photosensitive drum surface and thereby tend to limit and control the thickness of developer on the drum surface at the transfer station. The elements have different surfaces in sliding, frictional contact with the drum and roll respectively. In one embodiment the elements are strips with opposite parallel surfaces, one in contact with the drum and the other in contact with the roll. In another, the ends of the strip are mounted on reels so that the strip may be moved to vary wear points on the strip if any appear.

6 Claims, 6 Drawing Figures

METERING ROLL WITH FIXED SLIDER STRIPS

BACKGROUND OF THE INVENTION

The invention relates generally to photocopiers employing liquid toner developer, and particularly to apparatus for removing excess liquid developer from a photosensitive drum surface before transfer of the image to a copy material.

In a photocopier employing a rotating photosensitive drum surface, the drum surface is electrically charged and then exposed to an original light pattern to form a latent electrostatic image on the surface. The latent image is developed, for example by contacting a liquid developer to the image, and the developed image is transferred onto copy material by a transfer process. The drum is thereafter cleaned and used again.

In photocopiers employing liquid toner development, it is necessary prior to the transfer step to remove excess liquid developer remaining on the drum after development. The development process is not precise, and excess developer remaining on the drum surface can cause a blurry or fuzzy image on the transfer material and can excessively wet the transfer material so that drying would either take longer or be incomplete.

Among the devices used in the past to remove excess liquid from a wet surface have been rollers of one form or another. For example, in the printing and paper industry, it was common to rest a roller directly on the wet surface to remove excess liquid. (See for example U.S. Pat. No. 3,245,377, to Gettel). In those applications wherein the roller could not be placed directly upon the surface, various methods and apparatus for maintaining the roller spaced above the surface were employed. For example, the roller axis or shaft could be fixed to the apparatus frame (for example Australian Pat. No. 269855), or the roller could be supported by roller bearings which ride on, and are driven by, the surface being controlled. Each of these apparatus configurations was available prior to the introduction of the first plain paper liquid copiers, and apparatus employing the roller bearing method and apparatus described earlier were adopted almost simultaneously by at least two competing manufacturers for their commercial photocopiers. The manufacturers merely differed with respect to the direction of rotation of the operational roller, the different rotation directions having also been considered and disclosed previously in connection with related operating systems.

In each apparatus employing roller bearings to space the roller from the drum surface, the roller rotates with respect to the roller bearings. It is therefore imperative to provide bushings, bearings, or the equivalent structure between the two differently rotating parts. The adjustment, lubrication, and most importantly, the sealing of these roller bearings require careful attention, consideration, and control, and effectively increase the cost of the apparatus. Further, the commercial apparatus employing the roller bearing systems often employed hardened drum edges, for example, anodized aluminum, to further reduced wear from the rolling friction of the roller bearings on the drum.

In U.S. application Ser. No. 40,901, to Davis, filed May 21, 1979 and assigned to the same Assignee as the present application, there was disclosed a metering roll with distance control portions rigidly secured to its ends. The distance control portions had exterior dimensions selected to keep the central metering portion of the roll a fixed distance from the central drum surface. The surfaces of the distance control portions were in sliding frictional contact only with the surface of the drum against which they were biased.

That metering roll, however, still required a careful axial arrangement of multi-level surfaces to provide the required gap between the metering portion of the roll and the drum surface. It required careful dimensional control of the outer surface of the distance control portions, and if they were separately made, as is likely, careful coaxial alignment of the distance control portion and the metering portion when they are secured together.

Accordingly, it is an object of this invention to provide a reliable, relatively inexpensive metering apparatus that does not require the precise coaxial alignment of earlier metering rolls. A further object of the invention is to provide a metering apparatus that is easier and less expensive to manufacture, that has low wear characteristics, that has a long lifetime, and that is substantially unaffected by the liquid toner developer solutions.

SUMMARY OF THE INVENTION

The invention relates to copying apparatus having a rotatable drum with a reusable photosensitive surface. The apparatus further has a developing station where liquid toner is applied to the drum surface, and a transfer station.

The invention features a metering apparatus for controlling the thickness of the liquid toner on the drum prior to the transfer station and including a metering roll biased toward the drum and maintained a distance from it. An element is fixed between the drum and the roll, secured in an operative fixed position, and has a surface against which the drum slides and another surface against which the metering roll slides, the distance between the surfaces controlling the minimum distance between the drum photosensitive surface and metering roll.

In one preferred embodiment the element is a fixed strip extending between the drum and metering roll, the strip having opposite, flat, elongate, exterior surfaces in sliding contact with the drum and metering roll, respectively, at least one of the contacts being tangential. In another preferred embodiment the strip may be flexible, with one end windable on a takeup reel so that the strip can be selectively shifted and the contact points changed, to vary the wear points on the strip.

BRIEF DESCRIPTION OF THE DRAWINGS

Other objects, features and advantages of the invention will appear from the following description of particular preferred embodiments and the drawings, in which.

DESCRIPTION OF PREFERRED PARTICULAR EMBODIMENTS

Figure 1:
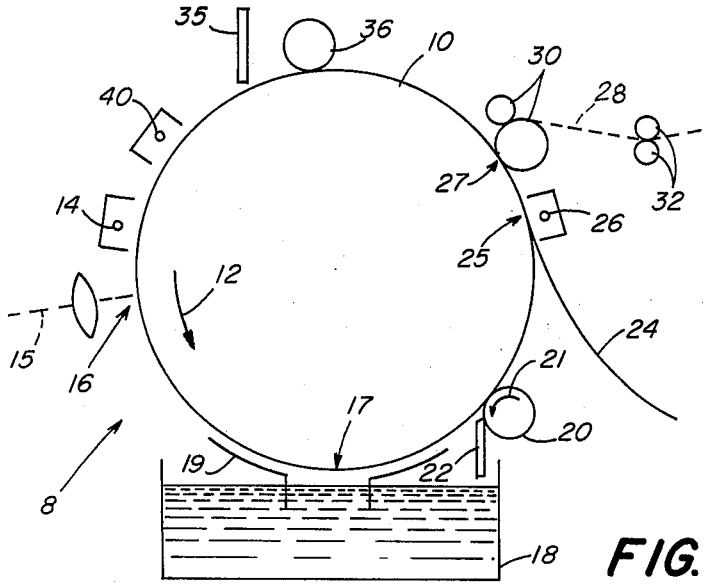
FIG. 1 is a schematic sectional view of a photocopier in which the present invention is incorporated.

Referring to FIG. 1, a typical photocopier 8 in which the present invention can be employed has a photosensitive drum 10, preferably one having a photosensitive selenium layer deposited on an aluminum substrate, rotating in the counterclockwise direction as indicated by arrow 12. A charge corona 14 charges the drum 10 to about +1000 volts D.C. The charged drum is exposed to an image 15 at an exposure station 16. The image is focused on the drum photosensitive surface and thereupon the charge on the drum surface forms an electrostatic latent image comprising a pattern of electrical charges. The electrostatic latent image on the drum surface is brought to a development station 17 where a liquid developer having, in the illustrated embodiment, a negatively charged toner, contacts the electrostatic image to develop the image. The development station includes a developer tank 18 and a development electrode 19. Developer is introduced between the development electrode and the drum surface to develop the electrostatic image. The drum surface, now wetted and carrying the developed image, travels past a metering roll 20 rotating also in the counterclockwise direction as indicated by arrow 21, which controls and limits the thickness of the liquid on the drum surface. A wiper 22 engages a central metering portion 23 (FIG. 2) of the metering roll 20, and removes the excess liquid that accumulates on the metering roll. A copy material 24, which is preferably sheet material, is fed to the drum surface at a transfer station 25. In this illustrated embodiment, a positive charge from a transfer corona 26 is applied to the back side of the copy material 24, causing the transfer of toner particles from the developed image on the drum's surface to the copy material. The copy material is then removed from the drum surface at 27 and follows a path 28 dictated by rollers 30 and 32.

After transfer, there remains on the drum a residue of liquid developer. The drum is continuously cleaned of this remaining residue by a surface contacting cleaning roller 36 and a cleaning blade 38. Finally, the drum surface is electrically neutralized prior to the next charging step by a high A. C. neutralizing charge from a discharge corona 40.

When the drum surface passes the surface area defined by the development electrode 19, it has on its surface the developed image plus an excess amount of liquid developer. If the transfer material 24 were brought into contact with the drum when it had the excess developer, the transfer sheet, if it were for example paper, would be excessively wetted and would be difficult to properly dry. In addition, the resolution of the transferred image could be reduced by an excessive amount of liquid on the drum. According to the preferred embodiment, the metering roll 20 is provided.

Figure 2:
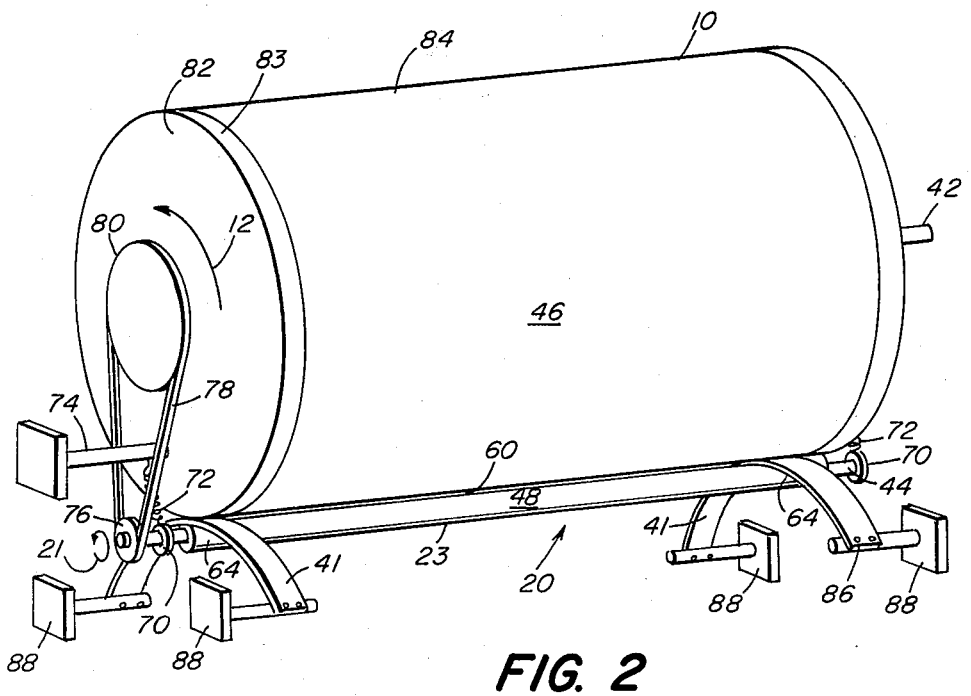
FIG. 2 is a perspective view of the drum and a metering roll apparatus according to a first embodiment of the invention.

Referring to FIG. 2, the structural relationship of the drum 10, the metering roll 20, and slider strips 41, separating the drum and the roll, is shown. Other elements of the photocopier 8 have been omitted for the sake of clarity. And the relative spacing and sizes of the metering roll 20 and the slider strips 41 have been exaggerated to enable a clearer understanding of the invention.

The drum 10 is mounted on a shaft 42 about which it is rotated in the direction shown by the arrow 12. The metering roll 20 is mounted by shaft members 44 about whose axes it is rotated in the direction shown by the arrow 21. The surface 46 of the drum 10 and the surface 48 of the metering roll 20, accordingly, are moving in opposite directions at the location of their closest approach. The surfaces 46 and 48 are separated from each other by a gap 60, however, because of the presence of the slider strips 41.

The metering roll 20 has the central metering portion 23 and end portions 64, which, in the illustrated embodiment, are different portions of a single cylinder of circular cross section, preferably made of aluminum and having an anodized surface to provide a hard durable surface. The metering roll shaft 44 extends from each end portion 64 and extends through spring biased bushings or bearings 70. The bushings or bearings 70 are connected by respective springs 72 to support mountings 74 secured to the frame (not shown) of the photocopier apparatus. The springs 72 urge the metering roll 20 toward the drum 10 and the strips 41. The illustrated metering roll shaft 44 has a drive gear 76 attached thereto. Gear 76 is driven by a chain 78 connected to a drive gear 80 mounted on the drum shaft 42. This drive structure causes metering roll 20 to rotate whenever the drum 10 is rotating, and in the same angular direction as the drum (compare arrows 12 and 21).

The surface 46 of the drum 10 in the illustrated embodiment has a substrate 82 of aluminum which is uncovered and visible at each edge 83 of the peripheral surface for a distance of about 0.5 inch. The central, photosensitive, portion 84 of the drum surface has a layer of photosensitive selenium approximately 0.0015 inch thick on the aluminum substrate. A typical width for the central portion 84 would be 8.5 inches.

Figure 3:
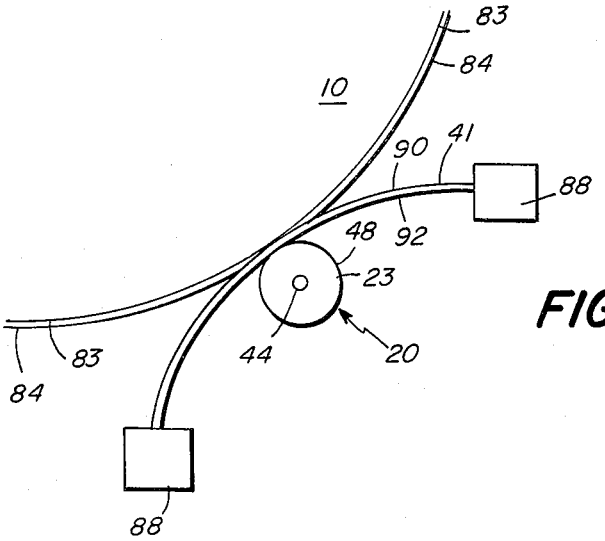
FIG. 3 is a detailed elevational, sectional view of one end of the metering roll apparatus shown in FIG. 2.

Referring now to FIG. 3 as well as FIG. 2, illustrated slider strips 41 are fixed at either end by fasteners 86 to support mountings 88 secured to the frame of the photocopier apparatus. The strips 41 pass between the end portions 64 of the metering roll 20 and the uncovered aluminum substrate edges 83 of the drum 10. The strips 41 extend perpendicularly to the parallel axes of the shafts 42, 44 of the drum and the roller. Referring to FIG. 3, for example, the axis of the shaft 44 of the metering roll 20 extends out of the paper in that view, while the strip 41 extends from one mounting 88 to the other mounting 88 in the plane of the paper. The strips 41 have substantially parallel, flat, elongate, opposite surfaces, an upper exterior surface 90 for sliding, frictional contact with the drum substrate 82, at the edges 83 and a lower exterior surface 92 for sliding, frictional contact with the metering roll 20. The strips 41 may be bowed one way or the other for convenience in attachment to the supports 88. In FIG. 3, the strip 41 is shown bowed so that its upper surface 90 is convex and contacts the drum 10 in substantially a tangential fashion. The lower surface 92 is concave as it contacts the roll 20. It may even contact the roll at more than a line contact, and contact the roll over an arc of greater of lesser extent, depending on the arrangement of the strip 41.

The width of the strips 41 is about 0.375 inch, to correspond to the width of the uncovered drum substrate 82. The thickness of the strips 41 is sized to maintain the central metering portion 23 of the metering roll 20 in the appropriate spaced apart relationship with the selenium photosensitive drum surface 84. To establish a gap 60 of 0.0015 inch between the metering portion and the selenium drum surface 84, then, taking into account the height of the selenium layer of 0.0015 inch, the thickness of the strip 41 should be about 0.003 inch in this preferred embodiment. (If the entire circumferential surface 46 of the drum 10 were uniformly covered with selenium, and it had therefore a substantially constant radius for its entire axial length, the thickness of the strip would have to be only 0.0015 inch, to provide a gap of 0.0015 inch.)

The slider strips 41 are preferably formed from a polyolefin such as the one sold under the trademark "Pennlon" by Dixon Corporation, Bristol, R.I. However other materials such as Teflon, vinyl acetals, olefins, Rulon, etc., that have the necessary lubricity and wear characteristics can also be employed. In particular, the material comprising the surfaces of the strips 41 should be self-lubricating to reduce sliding friction with drum 10, and roll 20, and should be hard and tough to provide long life.

Each slider strip 41 may be easily detachable from one or both of the supports 88 to which the strips are fixed for ease of removal of the drum 10. Often there is an arrangement for swinging the roll 20 away from the drum 10 so that the drum may be easily removed. The slider strips 41 could be similarly mounted so that they can be easily moved or pivoted away from the drum. The strips are fixed to the supports with enough slack so that the strips do not resist the biasing of the metering roll 20 provided by springs 72, which urges the metering roll toward the drum 10.

In operation, the metering roll 20 removes the excess liquid remaining on the photosensitive drum surface portion 84 after it passes the development station 17, that is, the step of contacting liquid developer to the drum at the development electrode. The gap 60 between the metering portion 23 and the drum surface is one of the parameters, as is well known in the art, which sets the thickness of the liquid developer presented to the transfer station 25.

Thus, according to the invention, the metering roll 20, driven by the drum shaft 42, rotates in the same angular direction as the drum so that its surface 48 is moving opposite the drum surface 46 at the gap 60. In the illustrated embodiment, the drum 10 can rotate, for example, at 34 rpm and the metering roll 20 can rotate, for example, at 396 rpm. Each end 64 of the roll 20 is in sliding, frictional contact with the adjacent surface 92 of the slider strip 41. The edge 83 of the drum substrate is in tangential, sliding, frictional contact with adjacent surface 90 of the strip 41, which is on the opposite side from the strip surface 92 engaged by the metering roll 20. The distance between the surfaces 90, 92 of the strip 41 and the diameter of end portions 64 determine the distance across the gap 60 between the drum 10 and the roller central portion 23 of the metering roll surface 48.

Figure 4:
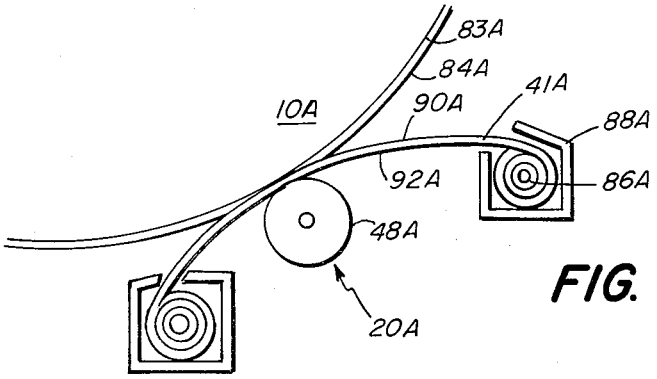
FIG. 4 is a view similar to that of FIG. 3, of a metering roll apparatus according to a second embodiment of the invention.

A second embodiment of the invention is shown in FIG. 4. As in the first embodiment, a strip 41A is maintained in a fixed position between the drum 10A and the metering roll 20A. The surface of the drum edge 83A is in sliding frictional contact with the upper surface 90A of the strip, and the metering roll surface 48A is in sliding frictional contact with the lower surface 92A of the strip. In this embodiment, however, rather than simply being attached by fasteners to fixed support elements (as in the first embodiment herein), the strip 50A is a ribbon-like element that is taken up by reels 86A in supports 88A that house the reels. A cassette-like structure is therefore formed by the supports 88A (which are connected to the housing, not shown) and the take up reels 86A.

The purpose of the cassette-like support 88A and reel 86A is to controllably shift the strip 41A to reduce the effect of wear generated at particular points of contact between surfaces of the strip and the drum and metering roll. The strip 41A continues to be "fixed" in position relative to the normal rotational movement of the drum and roll, but it may be shifted after a long period of operation in one "fixed" position to another strip position if objectionable wear occurs.

Figure 5:
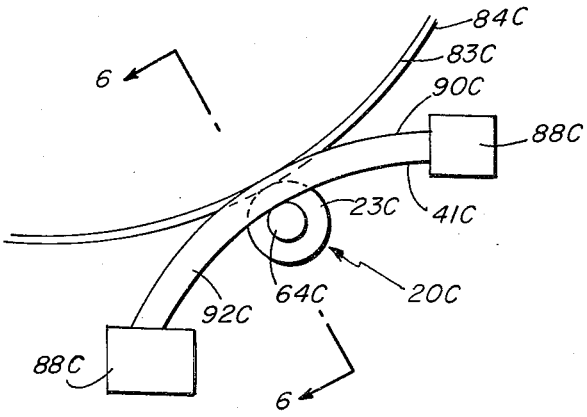
FIG. 5 is a view, similar to that of FIG. 3, of a metering roll apparatus according to a third embodiment of the invention.
Figure 6:
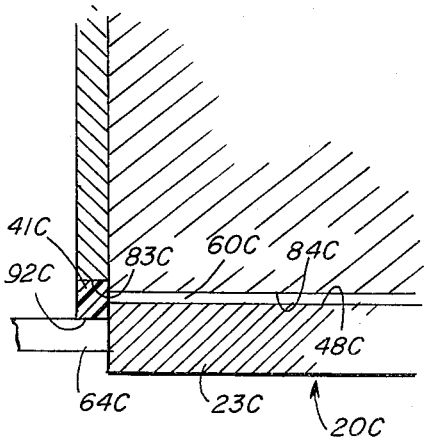
FIG. 6 is a sectional view along the lines 6—6 of the apparatus shown in FIG. 5.

A third embodiment of the invention is shown in FIGS. 5 and 6. In this embodiment, a metering roll 20C does not have a uniform cross section. Instead it has end portions 64C stepped down from a central metering portion 23C. Accordingly, an upper surface 90C of a slider strip 41C will be further apart from a lower surface 92C of the strip than was the case in the first embodiment, in order to maintain the same gap 60C between the drum photosensitive surface 84C and the surface 48C of the metering roll central portion 23. In other respects, the embodiment illustrated in FIGS. 5 and 6, is similar to that shown in FIG. 3. The upper surface 90C of the slider strip 41C is in sliding frictional contact with the surface of a drum substrate edge 83C, and the lower surface 92C is in sliding frictional contact with the surface of the metering roll end portions 64C. The strip 41C is, however, thicker than the strip 41 of the first embodiment, to make up for the stepped down characteristic of the end portions 64C. It may still be fastened to fixed mountings 88C, or, if the thickness of the strip does not unduly reduce its flexibility, be wound on reels like those shown in the second embodiment described above.

Other modifications of the disclosed embodiments are contemplated and would be within the scope of the invention. The spacer strips could be fastened to a variety of support structures in a variety of convenient ways. The orientation of the strip beyond the point where it lies between the metering roll end portions and the drum surface edges can be varied.

SUMMARY OF THE ADVANTAGES OF THE INVENTION AND NONOBVIOUSNESS

The metering roll apparatus according to the invention advantageously provides for a simple construction of the metering roll. It provides also for a simpler and more controllable structure for spacing the roll from the drum photosensitive surface.

Some prior art photocopy apparatus, for example that described in U.S. Pat. No. 3,957,016, U.S. Pat. No. 3,907,423, U.S. Pat. No. 4,023,899, and U.S. Pat. No. 4,052,959, appear to contemplate and require roller bearings on the ends of the roller in order to space the roller with respect to the drum. This is exactly the kind of structure which has been employed in connection with coating or printing equipment. Also, in the prior art copier systems the roller bearings are driven by the copier drum member in order to maintain a rotating, non-sliding, friction drive relationship between the drum and the bearings, and, according to the prior art, to reduce or minimize drum wear. Nevertheless, anodized hardened edge portions were considered necessary and were employed on the drum to further minimize the effects of wear.

The use of roller bearings is clearly described by earlier references which employ roller bearings to accomplish and achieve substantially the same effect. The use of those roller bearings in connection with photocopier rollers is a natural extension of the prior art systems.

The metering roll disclosed in Davis, U.S. Ser. No. 40,901, filed May 21, 1979 was itself a significant simplification in the structure of the metering roll, namely providing the distance control portions fixed at either end of the roll to be in sliding frictional contact with the drum. Because of this the metering roll had all its elements rotationally fixed, and bearings employed in prior art rollers were eliminated. Conveniently, the distance control end pieces could be detachably mounted on the central metering portion so that the distance control end pieces could be manufactured separately and thus easily be replaced since they were more likely to wear than the central portion of the roll.

The metering roll apparatus for this invention goes significantly further and eliminates the need for having coaxial distance control elements secured to the metering roll itself. With this new structure, the metering roll now could be, if desired, reduced to a simple cylinder of a constant circular cross section for its entire length. The metering roll need not have a constant circular cross section. The ends of the roll may be stepped down (and the sliders changed in width between sliding surfaces as shown in FIGS. 5 and 6). Even stepped down ends are relatively easy to accomplish, since they may be made along with the central metering portion of the roll, in a single lathe operation. The distance control elements are thus separate elements that are easily placed in, and removed from, the apparatus, to provide gap control. In either case the entire metering roll is manufactured, according to the invention, in a single operation.

The resulting elimination of the problems of coaxially aligning the distance control elements and the central metering portion, and the elimination of the problem of concentricity of the distance control portions provide significant advantages over prior art systems. And according to the present invention, the gap between the drum and metering roll is determined by the relatively easily maintained dimension of the thickness of a stationary distance control strip, ribbon or other fixed element.

Materials suitable for the sliding frictional contact contemplated by this invention may be dimensionally sensitive to heat, to the developing liquid, and to other parameters of the copier operating environment. The effects are, it appears, easier to control when the material is in the form of the simpler elements of the present invention, because a less complicated and stationary structure is involved.

Also since the distance control elements are fixed between the oppositely rotating drum and metering roll, the frictional effect is reduced. When, as in the previous application, the drum and distance control portions rotate against each other, their speeds add and provide a higher relative difference in velocity. In the present invention, the elements are fixed, and one surface is in contact with one rotating element, while the opposite surface is in contact with the other rotating element. The speeds of the rotating elements are not therefore cumulative in their effect.

Many variations of the shape of fixed distance control elements would have little effect on these advantages. And other additions, subtractions, deletions and other modifications of the disclosed embodiments will be obvious to those skilled in the art and are within the scope of the following claims.

What is claimed is:

1. In a copying apparatus having a rotating drum having a reusable photosensitive surface, a developing station for contacting liquid toner to said drum surface to develop an electrostatic image, and a transfer station for transferring said developed image to a transfer material, apparatus for controlling the thickness of said liquid toner on said drum prior to said transfer station, comprising:

a metering roll, means for biasing said metering roll toward said drum, and means for controlling the minimum distance from said drum surface to said metering roll comprising:

a strip member, means for securing said strip member between said drum surface and an end portion of said metering roll and perpendicularly to an axis of rotation of said drum, said securing means maintaining at least one end of said strip member in fixed position, said strip member having first and second surfaces, said drum surface being in sliding frictional contact with said first surface and said metering roll end being in sliding, frictional contact with said second surface.

2. The apparatus of claim 1 in which one of said first and second surfaces of said element is in tangential, sliding, frictional contact with one of said drum and said metering roll.

3. The apparatus of claim 1 further comprising means for shifting said element relative to said drum and metering roll.

4. The apparatus of claim 1 in which said element comprises a ribbon-like strip in which said first and second surfaces are opposite parallel surfaces of said strip.

5. The apparatus of claim 4 in which said securing means further comprises means for selectively shifting said strip in a plane normal to a drum rotation axis whereby the areas of contact between said strip and said drum and roll are changed.

6. In a copying apparatus having a rotating drum having a reusable photosensitive surface, a developing station for contacting liquid toner to said drum surface to develop an electrostatic image, and a transfer station for transferring said developed image to a transfer material, apparatus for controlling the thickness of said liquid toner on said drum prior to said transfer station, comprising:

a metering roll, means for biasing said metering roll toward said drum, and means for controlling the minimum distance between said drum surface and said metering roll, comprising:

a flexible strip member, means for securing said strip member between said drum surface and an end portion of said metering roll and perpendicularly to the axis of rotation of said drum, said strip member having opposite first and second flat, elongate, exterior surfaces, said drum surface being in sliding, frictional contact with said first surface and said metering roll end portion being in sliding, frictional contact with said second surface, at least one of said first and second surfaces being in tangential contact with at least one of said drum and said metering roll, and said securing means further comprising a translation control element and means for storing a supply of said flexible strip, and means for operating said control element for shifting said strip relative to said drum and metering roll, whereby wear points on said strip may be varied.

* * * * *